US007490698B2

(12) United States Patent
Sirag, Jr.

(10) Patent No.: US 7,490,698 B2
(45) Date of Patent: Feb. 17, 2009

(54) ELEVATOR TRAFFIC CONTROL

(75) Inventor: David J. Sirag, Jr., Ellington, CT (US)

(73) Assignee: Otis Elevator Company, Farmington, CT (US)

( * ) Notice: Subject to any disclaimer, the term of this patent is extended or adjusted under 35 U.S.C. 154(b) by 551 days.

(21) Appl. No.: 10/574,072

(22) PCT Filed: Oct. 8, 2003

(86) PCT No.: PCT/US03/31871

§ 371 (c)(1),
(2), (4) Date: Mar. 30, 2006

(87) PCT Pub. No.: WO2005/044708

PCT Pub. Date: May 19, 2005

(65) Prior Publication Data

US 2007/0007086 A1 Jan. 11, 2007

(51) Int. Cl.
*B66B 1/16* (2006.01)

(52) U.S. Cl. ..... 187/381; 187/383; 187/247

(58) Field of Classification Search ..... 187/247, 187/248, 380–388, 391, 393
See application file for complete search history.

(56) References Cited

U.S. PATENT DOCUMENTS

| | | | | |
|---|---|---|---|---|
| 3,648,805 | A | 3/1972 | Suozzo et al. | |
| 3,732,950 | A | 5/1973 | Savino | |
| 5,266,757 | A | 11/1993 | Krapek et al. | |
| 5,883,343 | A | 3/1999 | MacDonald et al. | |
| 5,955,708 | A * | 9/1999 | Amano et al. | 187/247 |
| 7,083,027 | B2 * | 8/2006 | Siikonen et al. | 187/383 |
| 7,434,665 | B2 * | 10/2008 | Bahjat et al. | 187/383 |

OTHER PUBLICATIONS

PCT International Search Report for Application No. PCT/US03/31871 dated May 6, 2004.
PCT Written Opinion dated Sep. 15, 2004 for International Application No. PCT/US03/31871.

* cited by examiner

*Primary Examiner*—Jonathan Salata
(74) *Attorney, Agent, or Firm*—Carlson, Gaskey & Olds

(57) ABSTRACT

An elevator traffic flow control strategy utilizes the advantages of sector assignment channeling and destination entry systems. A controller (30) monitors a handling capacity (62) of the system to determine when it is advisable to override the sector assignments (52) to provide improved passenger service.

24 Claims, 3 Drawing Sheets

ELEVATOR TRAFFIC CONTROL

FIELD OF THE INVENTION

This invention generally relates to directing elevator cars and passengers to specific elevator cars to maximize the efficiency of the elevator system.

DESCRIPTION OF THE RELATED ART

Elevator systems often include a plurality of cars that move between levels within a building for carrying passengers or cargo as needed. Depending on the size of the building, elevator systems can service a large traffic volume of passengers to a relatively high number of floors. In order to maximize the efficiency of the elevator system, different approaches are known for controlling the movement of the elevator cars.

One approach is known as channeling or sectoring where elevator cars are assigned to specific groups of floors (i.e., sectors) within a building so that each car returns to a lobby floor to accept new passengers in a manner that increases the traffic volume that the elevator system can handle. A variety of features and variations within channeling systems are known.

Another approach is sometimes referred to as a destination-entry-based system. Such systems acquire information regarding a passenger's intended destination in a lobby level, for example, before the passenger enters an elevator car. The destination information is used by the system to direct passengers to specific cars. One advantage to such destination entry systems is that they direct passengers to their assigned cars in a manner that is supposed to minimize lobby congestion.

While channeling systems are good for mass efficiency, they do not always give the best individualized service to a passenger. On the other hand, destination entry systems are good for individual service but often reduce the handling capacity of the elevator system.

There is a need for an improved arrangement that takes advantages of both channeling and destination entry systems to provide improved service during a variety of traffic volume conditions. This invention addresses that need.

SUMMARY OF THE INVENTION

In general terms, this invention is an elevator traffic control system that utilizes channeling to maximize the handling capacity of the elevator system but selectively overrides the channeling strategy when conditions are favorable to maximizing individual service for at least one passenger.

One system designed according to this invention includes a plurality of elevator cars. A controller determines the handling capacity of the elevator system. The controller determines a destination of at least one passenger and selectively overrides the sector assignment of at least one of the cars responsive to the determined destination. Overriding the sector assignment preferably occurs when the determined handling capacity is within a selected range.

In one example, the controller determines which car is the next one to leave and assigns the passenger to that car so that the passenger is able to proceed onto their chosen destination as soon as possible. In one example, the controller determines whether a car is assigned to a sector that includes the destination of the passenger and utilizes such a car for the passenger assignment.

The various features and advantages of this invention will become apparent to those skilled in the art from the following detailed description of a currently preferred embodiment. The drawings that accompany the detailed description can be briefly described as follows.

DETAILED DESCRIPTION OF THE PREFERRED EMBODIMENTS

Figure 1:
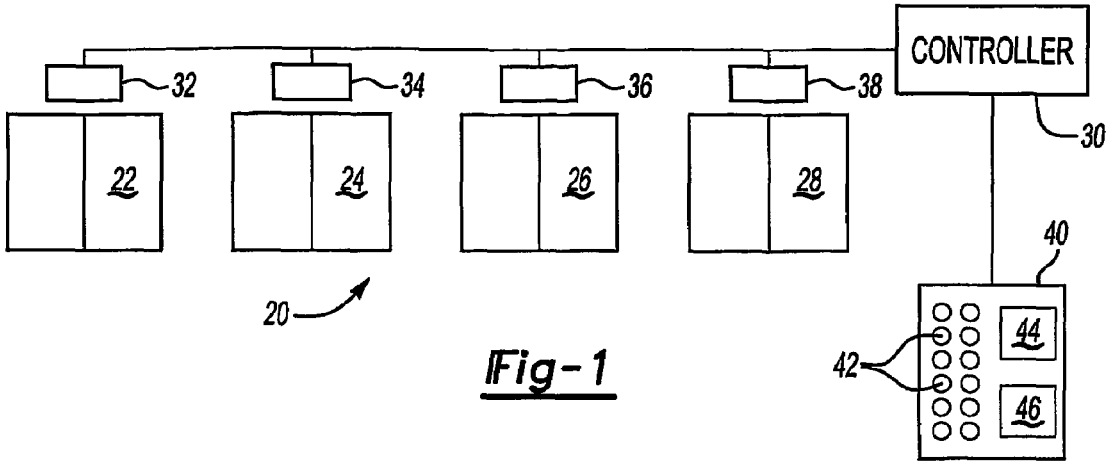
FIG. 1 schematically illustrates an elevator system incorporating a traffic flow control strategy designed according to an embodiment of this invention.

FIG. 1 schematically shows an elevator system 20 having a plurality of elevator cars 22, 24, 26 and 28. A controller 30 controls the movement of the cars in a manner to maximize the handling capacity of the elevator system. The controller 30 preferably uses known channeling techniques whereby the individual cars are assigned to specific sectors that include selected floors to which the cars are able to travel. The controller 30 controls displays 32, 34, 36 and 38, respectively, to provide an indication to passengers which floors each of the cars may reach. In one example, the displays are associated with each car at a lobby level to facilitate passengers boarding the appropriate car.

The illustrated example of FIG. 1 includes a primary destination entry device 40 that preferably is positioned in an appropriate portion of a building lobby or a main elevator system entry level. The primary destination entry device 40 includes a plurality of inputs 42 that allow passengers to indicate their desired destination. The inputs 42 in one example resemble the inputs on a car operating panel typically found in elevator cars. The illustrated example includes displays 44 and 46 that provide information to passengers and potential passengers such as directions for how to use the system to provide an early indication of their desired destination and to direct the passengers to the appropriate elevator car. Other variations on destination entry devices can include a 10 key keypad with a single display which displays an arrow pointing in the direction of the assigned car and a letter matching the letter displayed above the car, a smart card scanner with a preprogrammed destination, or a voice recognition system with speech output indicating the assigned car. The primary destination entry device 40 can take a variety of forms and those skilled in the art who have the benefit of this description will realize how to select appropriate components to meet the needs of their particular situation.

The controller 30 preferably overrides a strict sector or channeling assignment strategy when the handling capacity and the traffic rate information indicate that conditions are favorable to providing more customized service to at least one passenger that more resembles a destination entry system than a sector system. This invention combines the advantages of both such systems to maximize handling capacity on an as needed basis. The inventive arrangement also has the ability to minimize lobby congestion and provide passengers with individualized-feeling service when traffic flow conditions allow for such car assignments.

Figure 2:
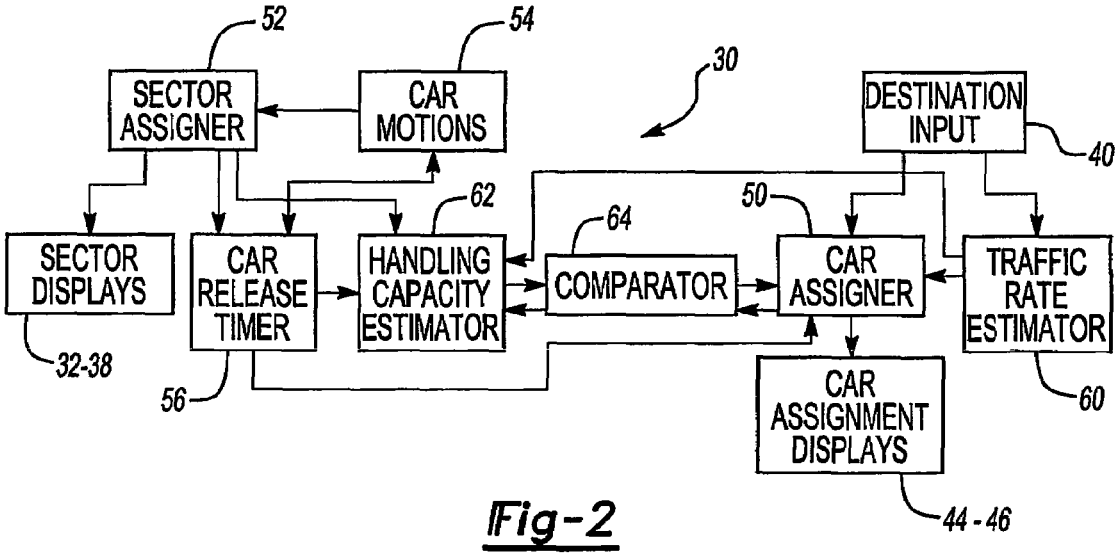
FIG. 2 schematically illustrates a controller that is useful with the embodiment of FIG. 1.

The controller 30 is schematically illustrated in FIG. 2. In this example, the controller utilizes information obtained at the primary destination entry device 40 so that a car assignor module 50 can assign the passenger to an appropriate car. It should be noted that the modules schematically shown in FIG. 2 are for discussion purposes and there may be overlapping software or components that perform functions of more than one module.

The controller 30 uses known channeling techniques to assign each of the elevator cars to an appropriate sector. A sector assignor module 52 includes the appropriate programming, hardware, firmware or a combination of these to achieve the desired channeling of the elevator cars. A car motion detector module 54 provides information to the sector assignor module 52 regarding positions of the elevator cars at all times during system operation. The sector assignor module 52 communicates with the displays 32-38 and a car release timer module 56 that is responsible for releasing the elevator cars to travel to appropriate floors after a determined lobby dwell interval. The controller 30 uses known techniques for monitoring elevator car movement and for estimating arrival times at the various locations to which the elevator cars need to travel, including the lobby or main entry level.

The controller 30 also includes a traffic rate estimator module 60 that uses information from the destination entry device 40 to estimate the rate that traffic is arriving at the elevator system. The traffic rate estimator module 60 in one example includes information regarding the arrival rate of passengers, the number of passengers currently waiting, the number of passengers inside of the cars and the rate at which the passengers are arriving to utilize the elevator system. Such information is communicated to the car assignor module 50 and a handling capacity estimator module 62. The handling capacity of the elevator system is based upon the current use of and demand for the elevator system. During periods of peak travel, the handling capacity is at a maximum or close to a maximum. During periods of low use, the handling capacity is not fully utilized and there is the possibility for more flexibility in assigning passengers to elevator cars outside of a strict channeling regimen, which is generally intended to maximize the handling capacity of the system.

The controller 30 includes a comparator module 64 that allows the car assignor 50 to make a car assignment based upon a comparison between the expected performance of the system using different car assignments, given appropriate information from the handling capacity estimator module 62 and the traffic rate estimator module 60.

Figure 3:
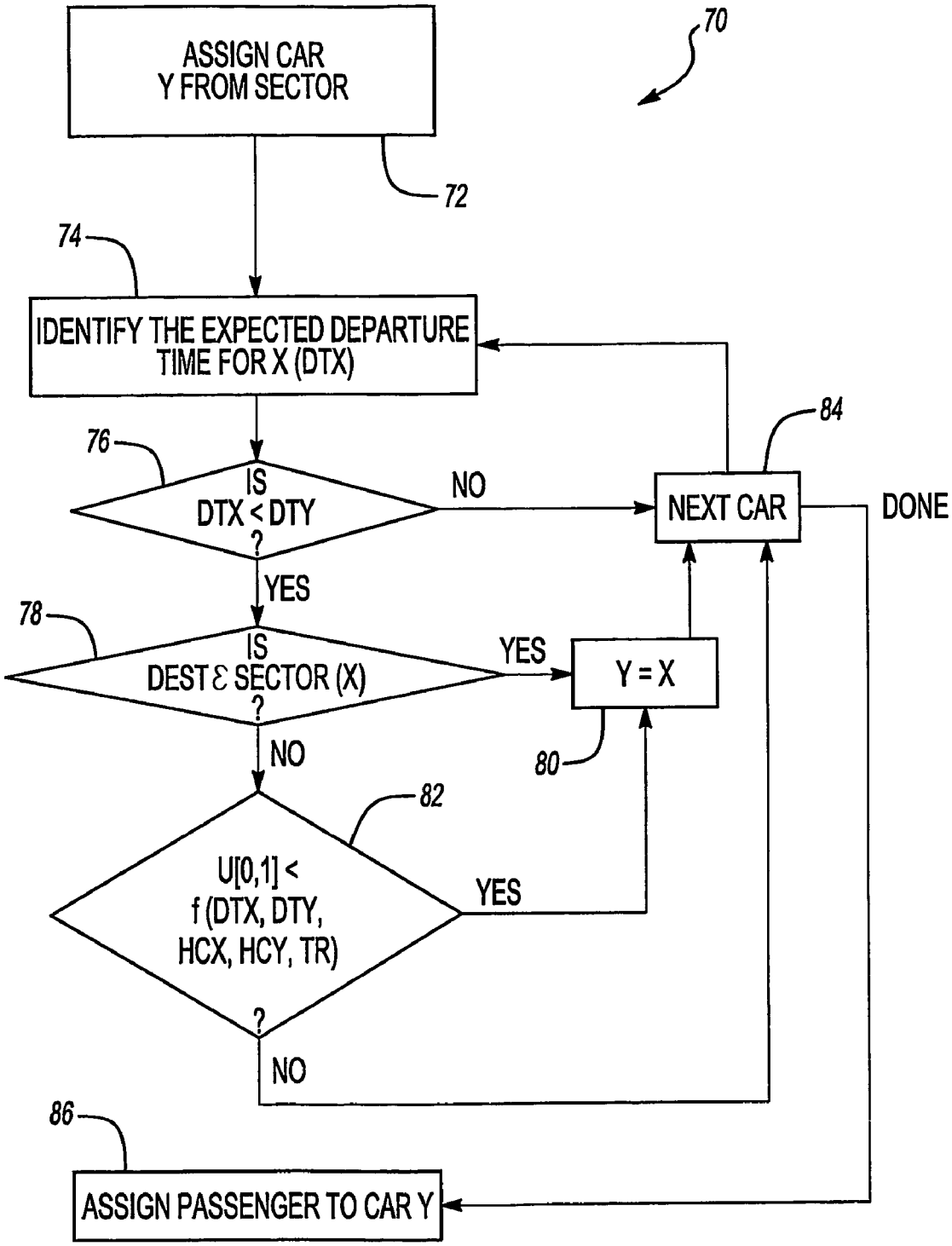
FIG. 3 is a flowchart diagram summarizing one example strategy for assigning a passenger to a car.

FIG. 3 includes a flow chart 70 that summarizes one decision process for assigning cars to one or more passengers. At 72, the controller 30 initially assigns car Y from the sector to which the passenger's entered destination belongs. At 74, the controller 30 identifies the expected departure time for another car X. The notation DTX indicates departure time for car X in FIG. 3. If DTX is less than the departure time for car Y (DTY) as determined at 76, then the controller determines at 78 whether the passenger's destination is within the sector to which car X is assigned. If so, the passenger is then assigned to the car X at 80. If not, then a comparison between the handling capacity of the elevator system and a selected threshold is made at 82 to determine whether the handling capacity is in a range that is favorable for overriding the sector assignment(s) of the channeling strategy. Assuming the handling capacity is within the acceptable range, the passenger is assigned to car X at 80.

In one example, a function for determining the handling capacity is described by the equation $f=1-(1/MAX(1, c*MAX(DTY-DTX, 0)-(HCY-HCX)/MAX(HCX-TR, 0)))$. Where: DTX is the time car X is expected to leave the lobby; TR is the traffic rate currently experienced by the system at the lobby level; HCY is the expected handling capacity of the system given the passenger being assigned to car Y and c is a constant.

The example function f has an output between 0 and 1 that captures the utility of assigning the passenger to car X instead of car Y. The function f should provide a result near 1 when it is better to assign the passenger to car X and should provide a result being 0 when it is better to assign the passenger to car Y.

The assessment provided by the function f is based upon the reduction in lobby waiting time (DTY−DTX), the loss of handling capacity (HCX−HCY) and the excess handling capacity (HCX−TR). In one example, the goal is to switch to car X if significant reductions in lobby waiting time can be achieved with minimal loss of handling capacity. The loss of handling capacity becomes less critical as long as a high excess handling capacity is maintained.

In the example of FIG. 3, the result of the function f is compared to a threshold described by U[0, 1]. This notation is intended to describe a random number function. In this example, the random number function chooses a number between 0 and 1. The use of a random number generator is known and those skilled in the art who have the benefit of this description will have the ability to incorporate such a function into a system designed according to this invention. Random number generators are a well known mechanism for allowing a highly discrete process (like an elevator car assignment) to respond in a measured way to gradually changing conditions. Using a random number generator the system avoids periodic behaviors which can lead to regularly occurring problems which can be noticed by regular users of the system.

The random number generation will mostly affect scenarios where the result of function f is somewhere in the middle of the possible range. For example, when there is no excess handling capacity, the value of f will be very close to 0. Accordingly, regardless of the random number generation, the threshold U will almost certainly be higher than 0 so that the car assignment does not override the normal sector assignments of the elevator system.

On the other hand, when there is excess capacity, the function f value will be closer to 1 so that the random number generation will not negatively impact the ability to override the normal sector assignment to make a passenger car assignment.

If the result of the comparison at 82 indicates that overriding the sector assignment (i.e., making an exception to the rule) is not a good idea, then the controller continues at 84 by making a comparison with the next car within the elevator system. Once every potential car has been processed, the final assignment of the passenger to car Y is communicated to the passenger through one of the displays 44 or 46 and may be reflected in the appropriate display 32-38, depending on the situation.

Given this description, those skilled in the art will be able to program an elevator system controller to perform the functions described above. Similarly, those skilled in the art who have the benefit of this description will be able to select from among commercially available computers, processors, electronics, hardware, firmware, software or a combination of these to realize a controller that performs the functions described above.

Other functions for determining the handling capacity and the advisability of overriding a sector assignment are within the scope of this invention. Those skilled in the art who have the benefit of this description will realize what factors to consider and how to weigh them to best meet the needs of their particular situation.

In another example, the inventive control strategy addresses situations where a passenger bypasses an early destination entry device and only enters their destination using a car operation panel within an elevator car. According to one example, the controller determines whether such a destination entry fits within the sector of the car chosen by that passenger. If the passenger's intended destination is outside of that car's assigned sector, the controller uses the inventive strategy to determine whether overriding the normal sector assignment is acceptable. Under conditions where the handling capacity will permit overriding the sector assignment, that car will be controlled in a manner to take that passenger to their intended destination floor even though it is not within the normal sector serviced by that car.

In one example when a passenger bypasses an early destination entry device and simply selects a floor within a car using the car operating panel, that passenger's destination is given lowest priority when that destination is outside of the car's assigned sector. Such an embodiment may provide passenger's more incentive to use the early destination entry devices, which enhances the elevator system's ability to manage traffic flow in the most efficient and effective manner.

Figure 4A:
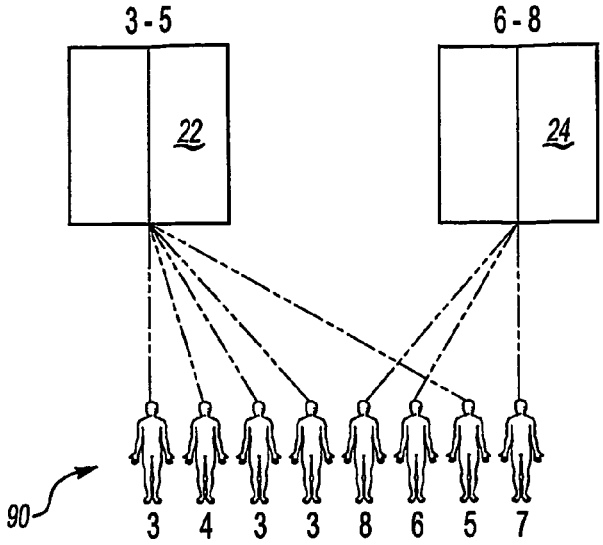
FIGS. 4A-4C schematically illustrate passenger car assignments using three different traffic flow control strategies.
Figure 4B:
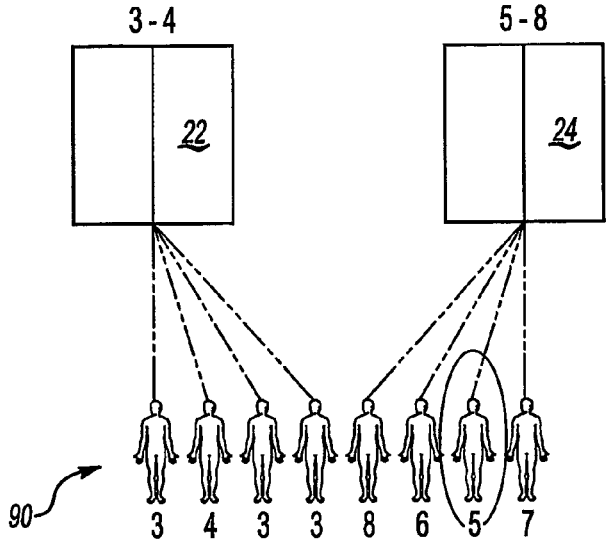
Figure 4C:
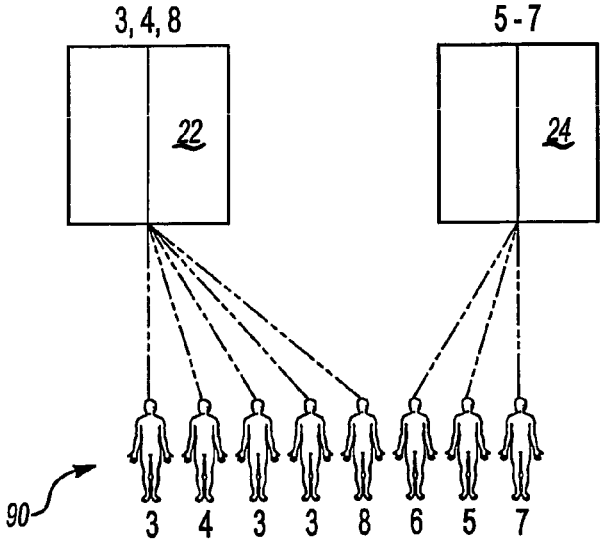

FIGS. 4A-4C show one advantage of a system designed according to this invention. FIG. 4A schematically shows a plurality of passengers that have entered their destinations prior to entering an elevator car. In this example, the elevator car 22 is assigned to a sector that serves floors 3-5 while the car 24 is assigned to a sector that serves floors 6-8. The passengers 90 are shown from left to right in the order that they arrive at the primary destination entry device 40. Each passenger is shown with their intended destination floor.

In this example, the first four passengers are directed to car 22 because of the sector assignment associated with their selected destination. The next two passengers intended to travel to floors 8 and 6, respectively. They are directed to the car 24. The following passenger intends to travel to floor 5 and is directed to the car 22. The last passenger intends to travel to floor 7 and is directed to car 24. One disadvantage with this strict sector assignment is that the first four passengers have to wait for the passenger traveling to floor 5 before the car 22 will leave the lobby. This additional waiting time may seem like an inconvenience to some passengers, depending on the situation.

FIG. 4C shows an example car assignment using a destination entry based system. In this example, the first five passengers are assigned to car 22. The last three passengers are assigned to the next car, 24. In this example, no sector assignment is premade for the cars so that the car 22 travels to floors 3, 4 and 8 while the car 24 travels to floors 5, 6 and 7. The example of FIG. 4C provides an improved waiting time for the first five passengers compared to that in FIG. 4A. The capacity of the system, however, is reduced because the car 22 must travel all the way to floor 8 before being able to return to the lobby to receive additional passengers. Additionally, the passenger traveling to floor 8 must wait for the stops at floors 3 and 4 before eventually arriving at floor 8, which may be perceived as an inconvenience.

FIG. 4B illustrates an example where the inventive strategy of overriding an initial sector assignment is utilized to improve passenger service without adversely impacting the handling capacity of the system. In the example of FIG. 4B, there is some excess handling capacity so that there is the possibility for overriding the strict sector assignment from FIG. 4A. In this example, the first four passengers are assigned to car 22 while the second four passengers are assigned to car 24. The difference between FIG. 4B and FIG. 4A is that the passenger traveling to floor 5 has switched from car 22 to car 24. That car assignment represents an override of the normal sector assignment from FIG. 4A where car 22 was assigned to a sector including floor 5. One advantage to the assignment of FIG. 4B is that the first four passengers have an improved lobby waiting time because the car 22 is able to depart without having to wait for the passenger traveling to floor 5 to arrive at the car. The passengers traveling to floors 6, 7 and 8 only experience a minor inconvenience of having to stop at floor 5 compared to their experience under the scenario of FIG. 4A.

FIGS. 4A-4C show how the inventive arrangement includes a blended advantage of a true sectoring system and a true destination entry based system. This invention includes the recognition that the full handling capacity of a channeling strategy is not always required and the extra capacity available at times can be traded to reduce passenger service time. The invention includes monitoring the excess handling capacity of the system and evaluating the negative impact on the handling capacity that would be caused by having a passenger assigned to an earlier departing car rather than a car assigned to the sector that includes the passenger's intended destination. According to the above described example, the tendency to assign a passenger to the next earliest departing car is generally proportional to the excess handling capacity and generally inversely proportional to the handling capacity reduction resulting from the assignment that is an exception to the sector strategy.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A method of controlling traffic in an elevator system, comprising the steps of:

assigning a plurality of elevator cars to respective sectors;

determining a handling capacity of the elevator system; and selectively controlling at least one of the cars to travel to a destination outside of the respective, assigned sector responsive to a destination indication from at least one passenger when the determined handling capacity is within a selected range.

2. The method of claim 1, including initially assigning a car to the one passenger based upon the sector to which the destination indication belongs and then reassigning the passenger to a different car that has a departure time that is earlier than the initially assigned car.

3. The method of claim 2, including reassigning the passenger to the different car if the handling capacity is within the selected range.

4. The method of claim 2, including reassigning the passenger to the different car if the destination indication is within a sector to which the different car is assigned.

5. The method of claim 2, including repeatedly reassigning the passenger to a different car that has an earlier departure time than a currently assigned car.

6. The method of claim 1, including determining a value of the handling capacity and comparing the determined value to a selected threshold.

7. The method of claim 6, including using a randomly generated number from within a selected range as the threshold.

8. The method of claim 1, including overriding the sector assignment of the one car when the handling capacity is below a selected threshold.

9. The method of claim 8, wherein the selected threshold corresponds to a heavy traffic volume and the capacity is near a maximum capacity.

10. An elevator system, comprising:

a plurality of elevator cars; and a controller that determines a handling capacity of the elevator system, determines a destination of at least one passenger and selectively controls at least one of the cars to travel to a destination outside of a sector assigned to the one car responsive to the determined destination when the determined handling capacity is within a selected range.

11. The system of claim 10, wherein the controller determines departure times of each of the cars from a base floor, the controller initially assigns a car to the one passenger based upon the sector to which the destination indication belongs and wherein the controller reassigns the passenger to a different car that has a departure time that is earlier than the initially assigned car.

12. The system of claim 11, wherein the controller reassigns the passenger to the different car if the handling capacity is within the selected range.

13. The system of claim 11, wherein the controller reassigns the passenger to the different car if the destination indication is within a sector to which the different car is assigned.

14. The system of claim 11, wherein the controller repeatedly reassigns the passenger to a different car that has an earlier departure time than a currently assigned car.

15. The system of claim 10, wherein the controller determines a value of the handling capacity and compares the determined value to a selected threshold.

16. The system of claim 15, wherein the controller uses a randomly generated number from within a selected range as the threshold.

17. The system of claim 10, wherein the controller overrides the assigned sector when the handling capacity is below a selected threshold.

18. The system of claim 17, wherein the selected threshold corresponds to a heavy traffic volume and the capacity is near a maximum capacity.

19. The system of claim 10, including a primary destination entry location outside of the elevator cars that is useable by a passenger to provide a destination indication and wherein the controller prioritizes the travel of the passenger based upon whether the passenger entered the destination indication at the primary entry location.

20. The system of claim 10, including a display that provides passengers with an indication of the car to which they are assigned.

21. The system of claim 12, wherein the controller maintains the sector assignment of the elevator cars while controlling the at least one car to travel to the destination outside of the sector assigned to the at least one car.

22. The system of claim 12, wherein the controller controls the at least one elevator car to travel to the destination outside of the assigned sector only during off-peak travel conditions.

23. The method of claim 1, including maintaining the respective sectors assigned to the elevator cars while temporarily overriding the sector assignment of the at least one of the cars.

24. The method of claim 1, including selectively controlling the at least one car to travel to the destination outside of the assigned sector only during off-peak travel conditions.

* * * * *